US009199121B2

(12) United States Patent
Ahn

(10) Patent No.: US 9,199,121 B2
(45) Date of Patent: Dec. 1, 2015

(54) EXERCISING DEVICE FOR LOWER-BODY

(76) Inventor: Jong Duk Ahn, Incheon (KR)

( * ) Notice: Subject to any disclaimer, the term of this patent is extended or adjusted under 35 U.S.C. 154(b) by 1748 days.

(21) Appl. No.: 13/133,943

(22) PCT Filed: Jun. 16, 2008

(86) PCT No.: PCT/KR2008/003365

§ 371 (c)(1),
(2), (4) Date: Jun. 9, 2011

(87) PCT Pub. No.: WO2008/156267

PCT Pub. Date: Dec. 24, 2008

(65) Prior Publication Data

US 2011/0287908 A1 Nov. 24, 2011

(30) Foreign Application Priority Data

Jun. 18, 2007 (KR) ..... 10-2007-0059645

(51) Int. Cl.
*A63B 21/00* (2006.01)
*A63B 23/04* (2006.01)
(Continued)

(52) U.S. Cl.
CPC ..... *A63B 23/0488* (2013.01); *A63B 21/00072* (2013.01); *A63B 21/023* (2013.01); *A63B 21/1492* (2013.01); *A63B 22/0056* (2013.01); *A63B 22/16* (2013.01);
(Continued)

(58) Field of Classification Search
CPC ..... A63B 21/00
USPC ..... 482/148, 67, 51, 75; 248/118; 297/411.1, 217.1
See application file for complete search history.

(56) References Cited

U.S. PATENT DOCUMENTS 284,024 A * 8/1883 Kelly ..... 482/142
2,644,688 A * 7/1953 Roberge ..... 482/148
(Continued)

FOREIGN PATENT DOCUMENTS

JP 3093204 1/2003
JP 2003-47672 2/2003
(Continued)

OTHER PUBLICATIONS

International Search Report for PCT/KR2008/003365 mailed Oct. 20, 2008.
(Continued)

*Primary Examiner* — Jerome w Donnelly
(74) *Attorney, Agent, or Firm* — Revolution IP, PLLC

(57) ABSTRACT

Provided is an exercise device for a lower body capable of simultaneously performing anaerobic exercise for leg muscle strengthening and stretching and aerobic exercise such as cycle pedal exercise. The exercise device for a lower body includes a pair of base bars 11 parallelly aligned with each other and having an arc shape; connecting shafts 12 fixed to side surfaces of center parts of the base bars 11 to opposite each other and having a pivot coupling structure installed therebetween; a pair of rotary arms 14 laterally pivotally hinged to upper surfaces of the center parts of the base bars 11 and having heel support frames 13 such that both feet are seated on upper surfaces of the rotary arms 11 to simultaneously perform anaerobic (static) exercise and aerobic (dynamic) exercise for leg muscles; and spring members 15 resiliently supported between the rotary arms 11 and the connecting shafts 12 to inwardly bias the rotary arms 14.

3 Claims, 5 Drawing Sheets

(51) Int. Cl.

| | |
|---|---|
| ***A63B 21/02*** | (2006.01) |
| ***A63B 22/00*** | (2006.01) |
| ***A63B 22/16*** | (2006.01) |
| *A63B 21/055* | (2006.01) |

(52) U.S. Cl.
CPC ..... *A63B 23/0405* (2013.01); *A63B 21/0552* (2013.01); *A63B 2022/003* (2013.01); *A63B 2208/0228* (2013.01); *A63B 2225/093* (2013.01)

(56) References Cited

U.S. PATENT DOCUMENTS

| | | | | |
|---|---|---|---|---|
| 5,868,651 | A * | 2/1999 | Washington | 482/91 |
| 2002/0091048 | A1 * | 7/2002 | Chen | 482/126 |
| 2007/0049473 | A1 * | 3/2007 | Chapman et al. | 482/121 |
| 2007/0072751 | A1 * | 3/2007 | Hsieh | 482/112 |

FOREIGN PATENT DOCUMENTS

| | | |
|---|---|---|
| KR | 10-2003-0013166 | 2/2003 |
| KR | 20-0394916 | 8/2005 |

OTHER PUBLICATIONS

Written Opinion of the International Searching Authority for PCT/KR2008/003365.

International Preliminary Report on Patentability for PCT/KR2008/003365.

* cited by examiner

EXERCISING DEVICE FOR LOWER-BODY

RELATED APPLICATIONS

This application is a 371 application of International Application No. PCT/KR2008/003365, filed Jun. 16, 2008, which in turn claims priority from Korean Patent Application No. 10-2007-0059645, filed Jun. 18, 2007, each of which is incorporated herein by reference in its entirety.

TECHNICAL FIELD

The present invention relates to an exercise device for a lower body, and more particularly, to an exercise device for a lower body capable of simultaneously performing anaerobic exercise for leg muscle strengthening and stretching and aerobic exercise such as cycle pedal exercise.

BACKGROUND ART

There is no room for doubt about importance of health, and professional physical educators or medical personnel recognize the state of the abdomen and correct posture as criterion of health. Though many peoples interested in health use various exercise equipment, most of the peoples failed to promote their health.

In general, exercise equipment uses the gravity load and is limited to one simple exercise such as sit-up, treadmill exercise, and so on, using the upper body and the lower body. Most of small exercise equipment is insufficient to exercise the entire body due to structural limitation caused by partial exercise, and thus, it is difficult to sequentially stimulate muscles related to peripheral parts of the exercise region and obtain synergy effect of the exercise.

That is, in all kinds of exercises, when composite lightweight exercise constituted by anaerobic exercise and aerobic exercise with correct posture is performed, fat is maximally burned and fine muscles are developed to maximize exercise effects within a short time. However, there is no exercise device capable of simultaneously performing the anaerobic exercise and aerobic exercise to obtain coordinate exercise effect.

A typical problem is that weight training is a burden to an exerciser from the beginning of the exercise. In addition, the weight training may cause injury during the exercise. Further, simple and repeated movements constituted by dynamic movement only, without static posture, make the exerciser feel tedious and difficult to abandon the exercise before purpose of the exercise is not accomplished.

DISCLOSURE OF INVENTION

Technical Problem

In order to solve the foregoing and/or other problems, it is an aspect of the present invention to provide an exercise device for a lower body capable of simultaneously performing static exercise (meridian massage and ankle pumping) and dynamic exercise (aerobic and weight training) using an exerciser's muscular strength, without load of the exercise device or the exerciser's weight, and being readily used by people of all ages and both sexes.

Technical Solution

One aspect of the present invention provides an exercise device for a lower body including: a pair of base bars parallelly aligned with each other and having an arc shape; connecting shafts fixed to side surfaces of center parts of the base bars to opposite each other and having a pivot coupling structure installed therebetween; a pair of rotary arms laterally pivotally hinged to upper surfaces of the center parts of the base bars and having heel support frames such that both feet are seated on upper surfaces of the rotary arms to simultaneously perform anaerobic (static) exercise and aerobic (dynamic) exercise for leg muscles; and spring members resiliently supported between the rotary arms and the connecting shafts to inwardly bias the rotary arms.

As can be seen from the foregoing, since anaerobic exercise and aerobic exercise for a lower body can be simultaneously performed using a single exercise device, it is possible to reduce a purchase price of an exercise device in comparison with individual exercise devices. In addition, since the exercise device is configured to be operated by an exerciser's will, not using the weight of the exercise device, there is no burden to the exerciser and probability of injury to the exerciser, thereby securing safety use of the exercise device.

While an exemplary embodiment of the present invention has been shown and described, it will be appreciated by those skilled in the art that various changes may be made to the embodiment without departing from the spirit and scope of the invention as defined by the appended claims and their equivalents.

DESCRIPTION OF MAJOR REFERENCE NUMERALS

Figure 1:
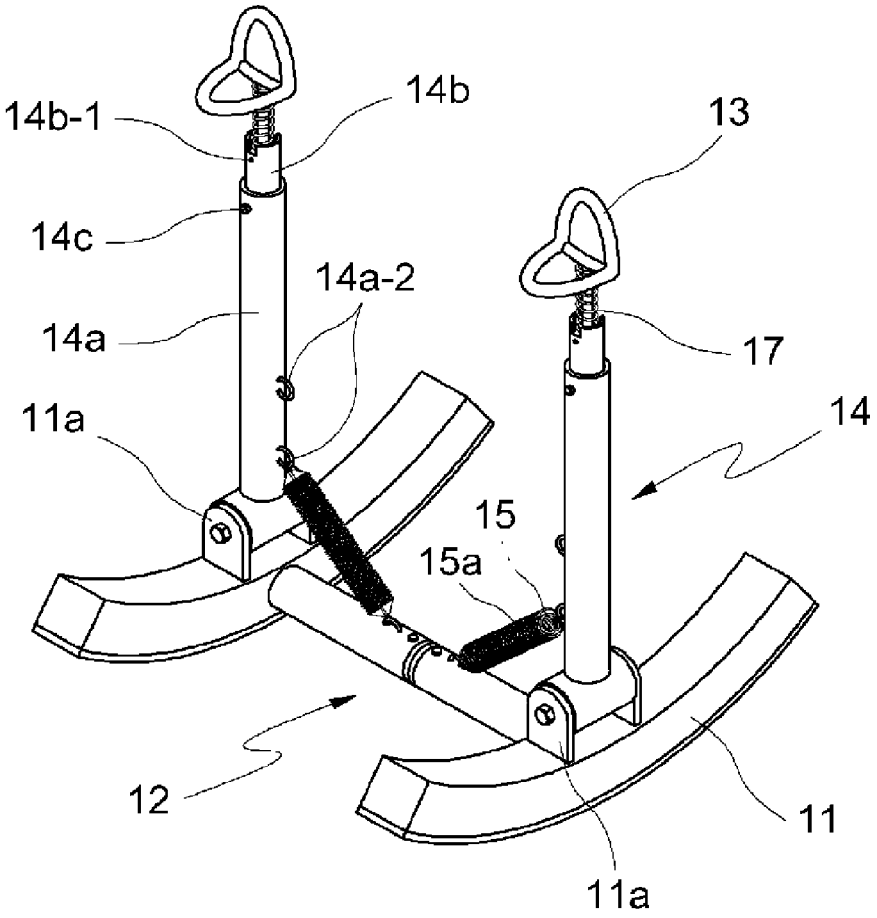
FIG. 1 is a perspective view of an exercise device for a lower body in accordance with an exemplary embodiment of the present invention.

11: Base bar 12: Connecting shaft
12*a*: Connecting piece 12*b*: Pivot pin
13: Heel support frame 14: Rotary arm
14*a*: Arm body 14*a*-1: Rotary unit
14*b*: Height adjustment arm 14*b*-1: Height adjustment hole
14*c*: Height adjustment pin 15: Spring member
15*a*: Bellows cover 16: Elastic rubber
17: Cushion coil

BEST MODE FOR CARRYING OUT THE INVENTION

In order to accomplish the object, the present invention provides an exercise device for a lower body including:

a pair of base bars parallelly aligned with each other and having an arc shape;

connecting shafts fixed to side surfaces of center parts of the base bars to opposite each other and having a pivot coupling structure installed therebetween;

a pair of rotary arms laterally pivotally hinged to upper surfaces of the center parts of the base bars and having heel support frames such that both feet are seated on upper surfaces of the rotary arms to simultaneously perform anaerobic (static) exercise and aerobic (dynamic) exercise for leg muscles;

and spring members resiliently supported between the rotary arms and the connecting shafts to inwardly bias the rotary arms.

Mode for the Invention

An exemplary embodiment of the present invention will now be described in detail with reference to the accompanying drawings.

Figure 2:
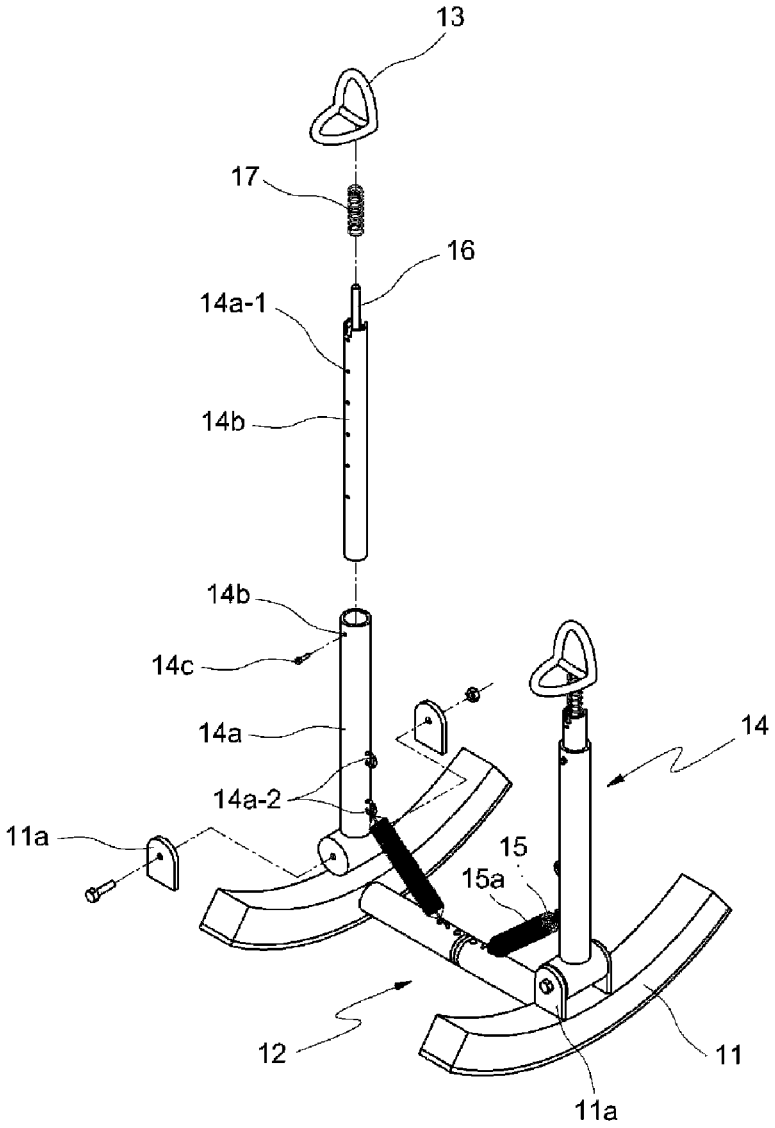
FIG. 2 is an exploded perspective view showing constitution of the exercise device for a lower body in accordance with an exemplary embodiment of the present invention in detail.
Figure 3:
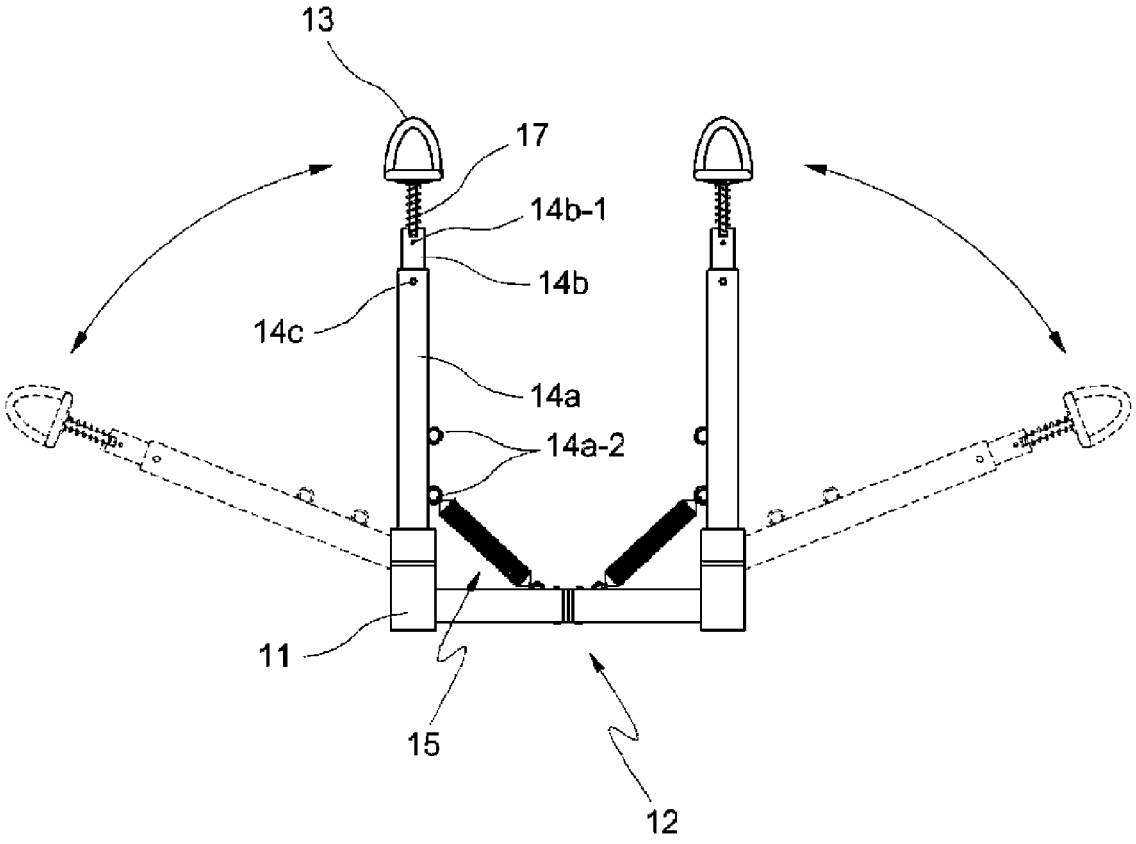
FIG. 3 is a front view of the exercise device for a lower body in accordance with an exemplary embodiment of the present invention.
Figure 4:
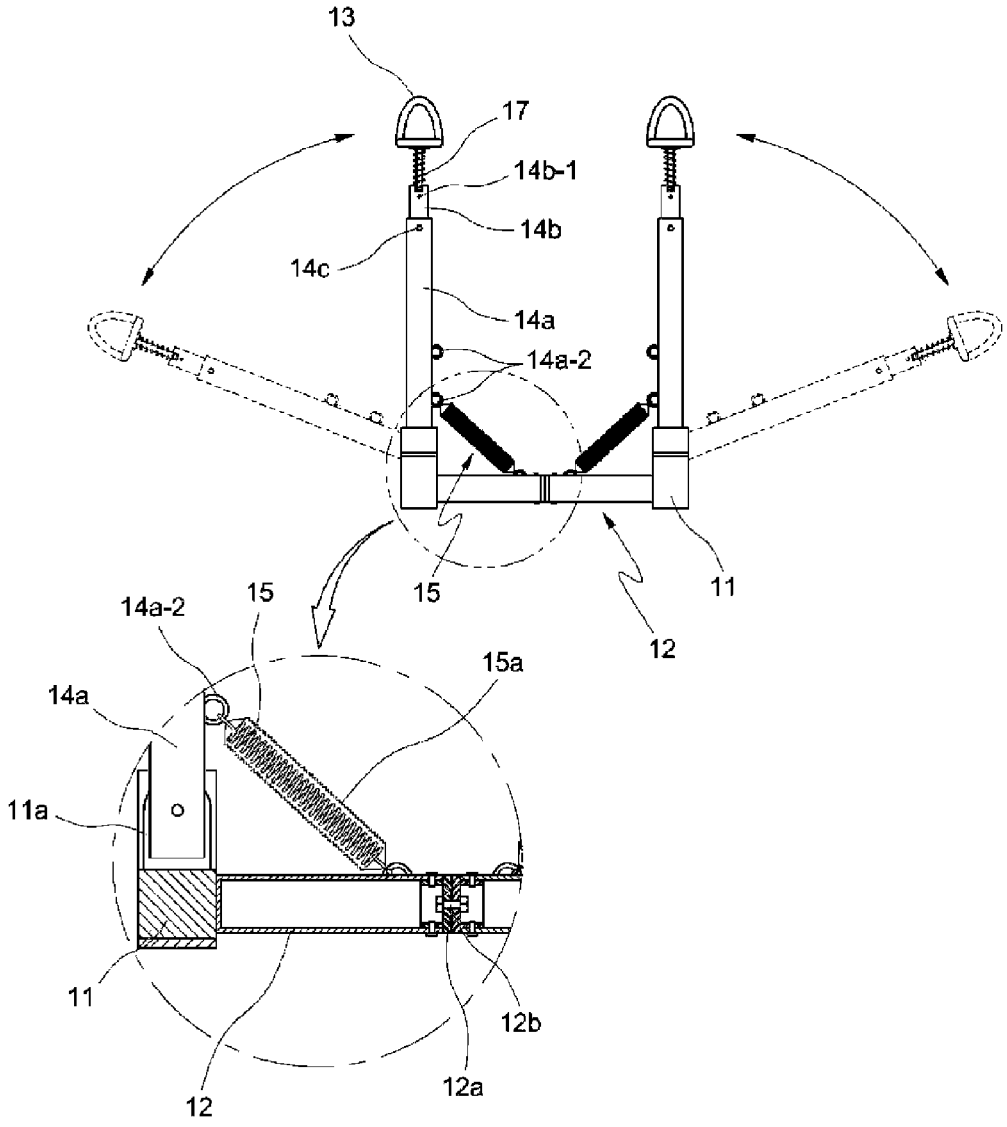
FIG. 4 illustrates a view showing operation of one embodiment of the exercise device for a lower body, and a partially enlarged view.
Figure 5:
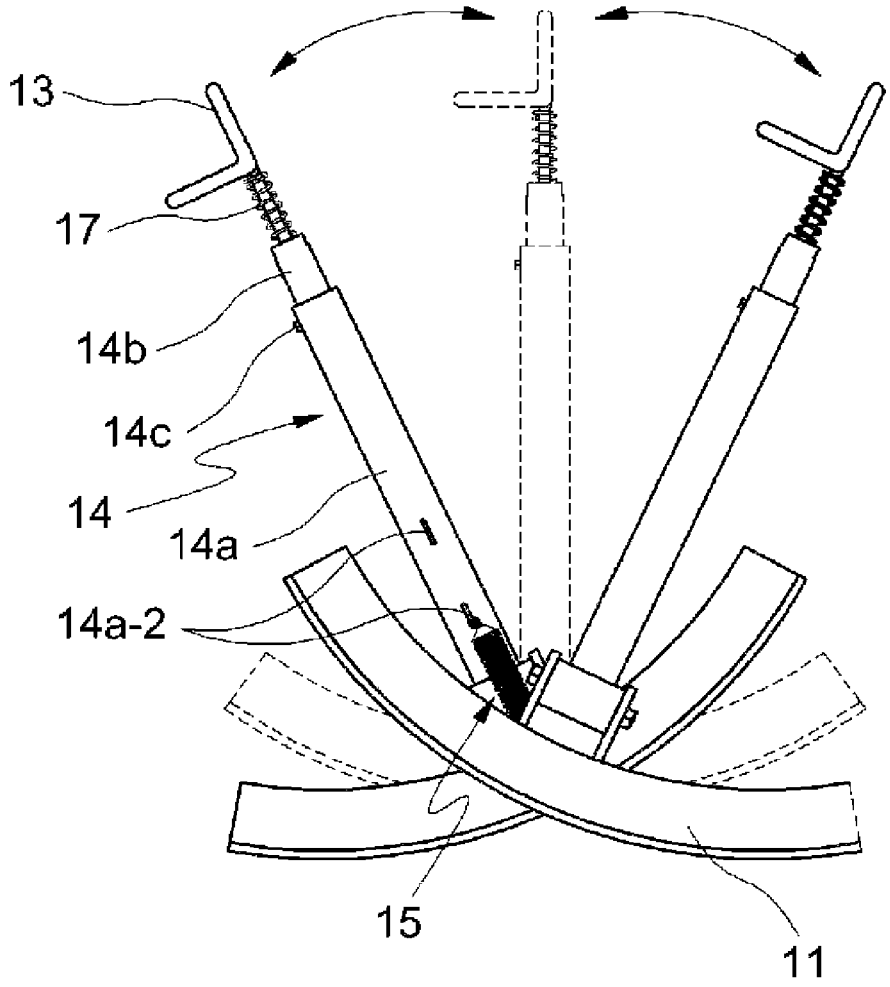
FIG. 5 illustrates a view showing another operation of the exercise device for a lower body in accordance with an exemplary embodiment of the present invention.

FIG. 1 is a perspective view of an exercise device for a lower body in accordance with an exemplary embodiment of the present invention, FIG. 2 is an exploded perspective view showing constitution of the exercise device for a lower body in accordance with an exemplary embodiment of the present invention in detail, FIG. 3 is a front view of the exercise device for a lower body in accordance with an exemplary embodiment of the present invention, FIG. 4 illustrates a view showing operation of one embodiment of the exercise device for a lower body, and a partially enlarged view, and FIG. 5 illustrates a view showing another operation of the exercise device for a lower body in accordance with an exemplary embodiment of the present invention.

As shown in FIGS. 1 to 3, the present invention includes base bars 11 parallelly aligned with each other.

The base bars 11 have the same arc shape with convex center parts, and connecting shafts 12 are fixed to inner surfaces f the center parts of the base bars 11 to opposite to each other.

In addition, connecting pieces 12*a* are inserted into ends of the connecting shafts 12, and pivot pins 12*b* are rotatably coupled to centers of the connecting pieces 12*a* to connect the connecting shafts 12 and individually move the base bars 11 depending on movement of rotary arms 14, which will be described.

Meanwhile, brackets 11*a* are installed at upper surfaces of the center parts of the base bars 11, and a pair of rotary arms 14 are coupled to the brackets 11*a* by bolts and nuts and have a rotation route perpendicular to movement of the base bars, respectively. Each of the rotary arms 14 includes an arm body 14*a* rotatably coupled to the bracket 11*a* by a bolt-nut coupler and having a through-hole 14*a*-1 formed at an upper end thereof, a height adjustment arm 14*b* having a heel support frame 13 coupled to its upper part, slidably coupled to project from and enter the arm body 14*a*, and having a plurality of height adjustment holes 14*b*-1 formed in a longitudinal direction thereof at predetermined intervals, and a height adjustment pin 14*c* inserted into the through-hole 14*a*-1 and an arbitrary height adjustment hole 14*b*-1 aligned thereto to adjust the height of the rotary arm 14.

In addition, a locking ring 14*a*-2 is formed inside the rotary arm 12, specifically, at an inner part of the arm body 14*a*. A spring member 15 is installed between the locking ring 14*a*-2 and an eccentric side of the connecting shaft 12 to inwardly bias the rotary arm 14.

The spring member 15 may be a coil spring, or may be a latex rubber wire having high tension.

Further, a bellows cover 15*a* is installed around the spring member 15 to freely extends or shrink depending on resilient displacement of the spring member 15 to prevent injury to a user.

Meanwhile, the heel support frame 13 installed at the upper end of the rotary arm 14 is supported by an elastic rubber 16, and a cushion coil 17 is installed around the heel support frame 13 such that the support frame 13 can be freely tilted.

In addition, the heel support frame 13 is configured to safely fix the instep and ankle of the exerciser, and formed of a material having good cushion to minimize fatigue due to the exercise of the lower body.

Hereinafter, operation of the exercise device for a lower body in accordance with an exemplary embodiment of the present invention will be described.

As described above, the exercise device for a lower body in accordance with an exemplary embodiment of the present invention can simultaneously perform anaerobic exercise and aerobic exercise as described above.

That is, as shown in FIG. 4, in the anaerobic exercise, since the rotary arms 14 hinged to the brackets 11*a* formed at the upper surfaces of the center parts of the base bars 11 have a rotation route perpendicular to a longitudinal direction of the base bars 11 and the spring members 15 always pull the rotary arms 14, an exerciser can put his/her feet on the heel support frames 13 with lay or sat on a chair and press the rotary arms 14 to widen the rotary arms 14 with power that overcomes the resilient force, thereby stably stretching his/her body.

Here, core technology of the present invention is that an exercise load is applied by an exerciser's muscle power only, not the weight or gravity of the exercise device. Therefore, it is possible to prevent secondary injury due to the exercise and thus allow people of all ages and both sexes to enjoy the exercise without any burden.

In addition, in the aerobic exercise, as shown in FIG. 5, since the connecting shafts 12 are fixed to the base bars 11 but are freely rotatably coupled to each other by the pivot pins 12*b* in a rotational direction thereof, the exerciser can perform leg training like pedals of a bicycle. At this time, the exerciser can perform the leg training with his/her will using interference of the spring members 15, without influence by the weight of the exercise device.

Further, the exerciser can simultaneously perform two operations to draw a circle to exercise both the anaerobic exercise and aerobic exercise.

The invention claimed is:

1. An exercise device for a lower body comprising:

a pair of base bars parallelly aligned with each other and bent in an arc shape;

a connecting shafts fixed to center parts of the pair of base bars, the connecting shafts including a bracket installed at upper surfaces of each of the pair of base bars;

a pair of rotary arms including a first and a second end, the first end of the rotary arms being hinged to the bracket in vertical directions and the second end of the rotary arms coupled to heel support frames using a coil installed at the second end of the rotary arms to tilt the heel support frames in all directions;

a locking ring formed inside of each of the rotary arms;

a spring member is installed between the locking ring and an side of a connecting shaft to resiliently bias the rotary arms; and a base bar including the bracket coupled the base bars and connecting pieces, wherein the connecting pieces are formed into ends of the connecting shafts, and pivot pins are rotatably coupled to centers of the connecting pieces to connect the connecting shafts, and wherein the base bars are individually moved according to movements of rotary arms, wherein each of the rotary arms is hinged to the bracket formed at the upper surfaces of the center parts of the base bars having a rotation route perpendicular to a longitudinal direction of each of the base bars, and the spring member resiliently pulling the rotary arms.

2. The exercise device for a lower body according to claim 1, wherein each of the rotary arms further comprises:

an arm body hinged to the base bars and including a through-hole formed at an upper end thereof;

a height adjustment arm slidably coupled to project from and enter the arm body;

a plurality of height adjustment holes formed in a longitudinal direction thereof at predetermined intervals; and a height adjustment pin inserted into the through-hole 14*a*-1 and a height adjustment hole aligned thereto to adjust the height of the rotary arms.

3. The exercise device for a lower body according to claim 1, wherein the heel support frames coupled to upper ends of the rotary arms that are supported by elastic rubbers, and cushion coils that are installed around the heel support frames wherein the heel support frames are tilted in all directions.

* * * * *